United States Patent [19]

Jarvis

[11] 4,055,367

[45] Oct. 25, 1977

[54] LONGWALL MACHINE WITH CAPTIVATING BRACKET

[75] Inventor: William Joseph Jarvis, Bestwood, England

[73] Assignee: Coal Industry (Patents) Limited, London, England

[21] Appl. No.: 709,243

[22] Filed: July 27, 1976

[30] Foreign Application Priority Data

Aug. 13, 1975 United Kingdom ..... 33645/75

[51] Int. Cl.[2] ..... E21C 27/36

[52] U.S. Cl. ..... 299/53; 299/43

[58] Field of Search ..... 299/32, 33, 34, 43, 299/53; 61/45 D

[56] References Cited

FOREIGN PATENT DOCUMENTS

| | | | |
|---|---|---|---|
| 2,121,156 | 12/1971 | Germany | 299/43 |
| 1,088,999 | 10/1967 | United Kingdom | 299/43 |

*Primary Examiner*—Ernest R. Purser

*Attorney, Agent, or Firm*—James C. Wray

[57] ABSTRACT

A ranging arm mining machine traversable to and fro along a fixed guide extending along a working face is provided with a bracket assembly secured to a support trunnion for a ranging arm carrying a cutter drum such that in use the machine is trapped or captivated to the guide.

10 Claims, 3 Drawing Figures

LONGWALL MACHINE WITH CAPTIVATING BRACKET

This invention relates to mining equipment and in particular to mining equipment which in use is mounted on a ranging arm mineral mining machine to trap or captivate the mining machine to a guide extending along one side of the machine along a working mineral face.

It is known to provide trapping or captivating means mounted on a supporting underframe for a mining machine, the underframe extending beyond the end of the machine. However, with a ranging arm machine the underframe cannot extend beyond the end of the machine adjacent to the ranging arm. Otherwise ranging of the arm would be impeded. Consequently, it is difficult to find a satisfactory way of attaching the trapping or captivating means to the underframe adjacent to the ranging arm.

An object of the present invention is to provide mining equipment which enables the end of a ranging arm mining machine to be trapped or captivated to a guide extending along one side of the machine.

According to the present invention, mine equipment for trapping or captivating a ranging arm mining machine to a guide extending along one side of the machine along a working face includes a bracket assembly securable to a support trunnion on the machine for the ranging arm, the bracket assembly comprising a first component for attachment to the support trunnion, and a second component for extending around the guide such that in use when the bracket assembly is mounted on the support trunnion the machine is trapped or captivated to the guide.

Conveniently, the bracket assembly is adapted to help support the weight of the machine.

Advantageously, the second component is provided with at least one roller for engaging the guide.

The present invention also provides a ranging arm machine comprising mine equipment as defined above, each bracket assembly being mounted on a support trunnion.

By way of example only, the embodiment of the present invention will be described with reference to the accompanying drawings in which.

Figure 1:
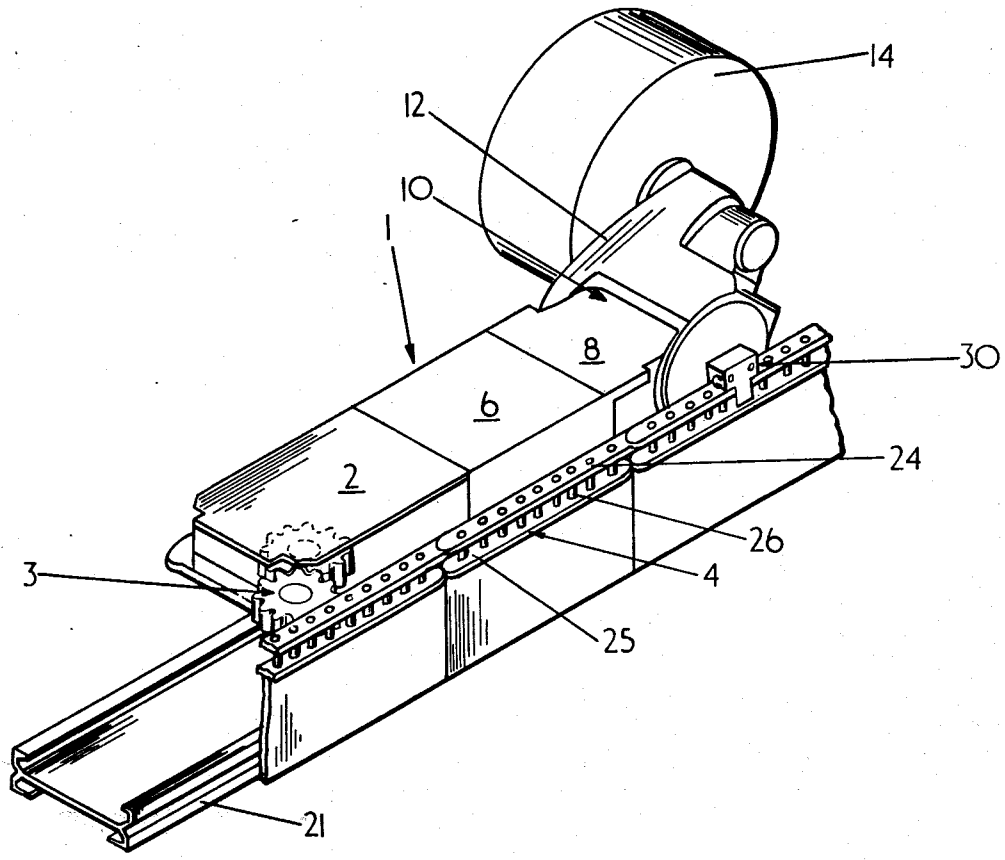
FIG. 1 is a perspective view of a ranging arm machine having a bracket assembly constructed in accordance with the present invention.
Figure 2:
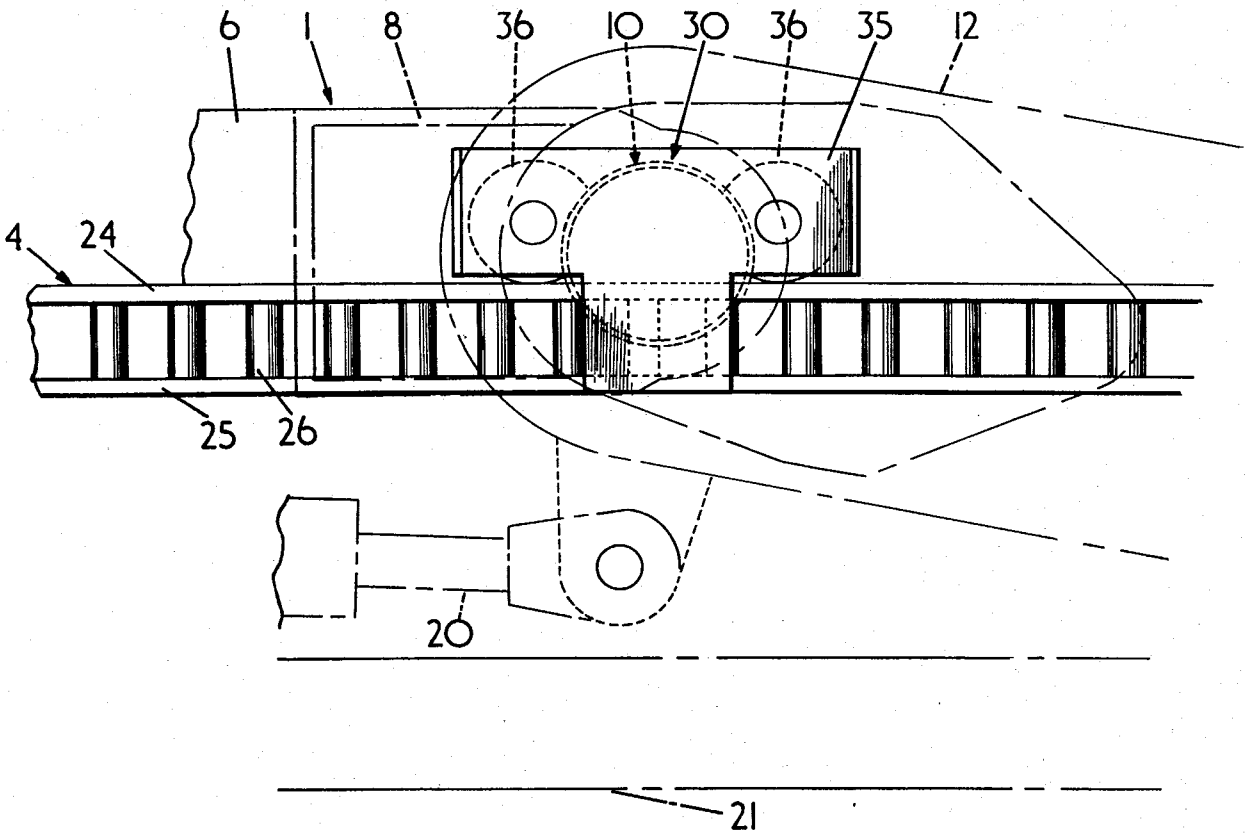
FIG. 2 is an incomplete side view of a detail of FIG. 1.

FIG. 1 of the drawings shows a single ranging arm shearer type coal mining machine which in use repeatedly traverses to and fro along a longwall face. The machine has a body 1 including a haulage section 2 having driven pinions 3 for drivably engaging a rack 4 of a track assembly which also provides a guide for the machine, a motor section 6 for driving the haulage section and a cutter section 8 having a support trunnion 10 for a ranging arm 12 carrying a rotary cutter drum 14 which has cutter picks and cut-mineral loading vanes (not shown) for cutting and loading won mineral, respectively. The cutter section 8 includes gearing driven from the motor section and driving gearing within the ranging arm 12 for rotating the cutter drum. The arm is ranged up and down by a hydraulic ram (not shown in FIG. 1 but a part of which is indicated by 20 in FIG. 2) located between pivotal mountings on the cutter section and on the ranging arm, respectively.

In use the machine traverses to and fro along the track assembly including the rack 4 and a series of armoured conveyor pans 21 which are arranged along the longwall face and onto which the cutter drum loads won mineral. An endless chain and transverse flight arrangement (not shown) is hauled along the deck of the conveyor pans in well known manner.

The rack 4 of the track assembly is constituted by a plurality of rack units each comprising an upper plate 24 and a lower plate 25 and a series of vertical pins 26 which are fixedly located between the plates 24, 25 and which are drivably engaged by one of the pinions 3 to move the machine along the track assembly. The ends of the upper plate 24 are concaved and convexed, respectively, so as to engage the ends of adjacent rack units in such a manner that the rack units tend to be retained in alignment. The vertical plates supporting adjacent rack units are connected with a link plate and bolts (not shown) which maintains the end pins of adjacent rack units within an acceptable pitch but which permits limited articulation of adjacent rack units. The conveyor pans are connected by bolts (not shown) which are left slack to allow the limited articulation as the track assembly including the conveyor is advanced in "snake" like manner towards the newly formed working face.

Figure 3:
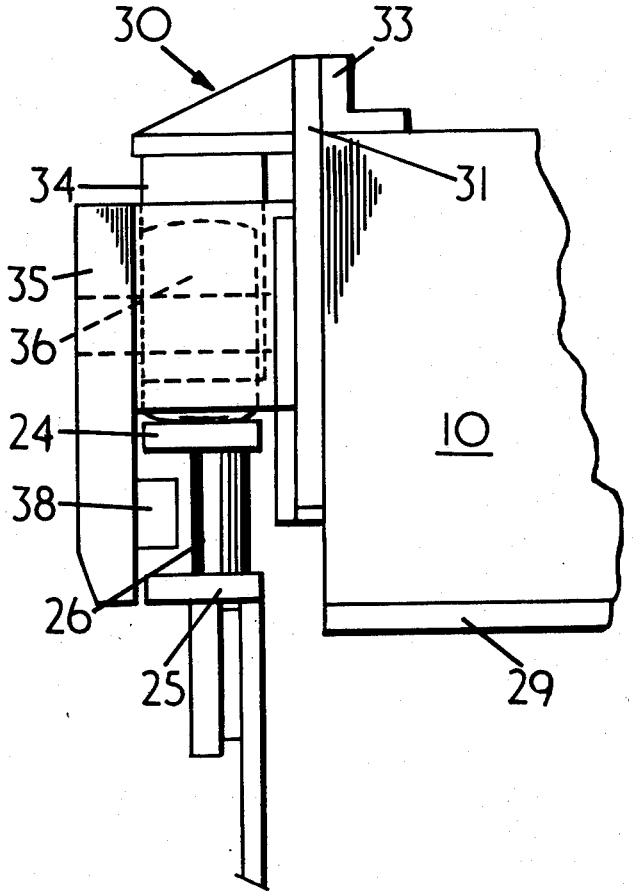
FIG. 3 is an incomplete end view of the detail of FIG. 2.

In order to ensure that the pinions 3 remain in drivable engagement with the pins of the track assembly the machine must be trapped or captivated to the rack units. This is achieved by having a captivating member (not shown) which is secured to a supporting underframe 29 (see FIG. 3) for the machine and mounted adjacent to the pinion 3 and which extends over and around the rack unit so as to lie on the side of the pins remote from the pinions 3. The captivating member also has a lip which projects between the upper and lower plates 24, 25 on the side of the pins remote from the pinion in order to retain the captivating member on the track assembly and thereby trap or captivate the end of the machine adjacent to the pinions 3 to the track assembly. The captivating member may be provided with horizontal rollers for engaging the upper surface of the upper plate 24 to support the machine.

In addition a further captivating member 30 is provided adjacent to the cutter section end of the machine. The captivating member 30 is shown in more detail in FIGS. 2 and 3 and comprises a first component 31 (which is omitted from FIG. 2 for the sake of clarity) fixedly bolted to the circular end of the support trunnion 10 for the ranging arm and to the upper surface of the cutter section via an angle bracket 33. A second component 34 extending outwardly from the first component includes a generally "T"-shaped support frame 35 for two horizontal rollers 36 which roll along the upper surface of the upper plate 24 supporting the machine. The vertical limb of the generally "T"-shaped support frame has a pad 38 located between the upper and lower plates 24, 25 of the rack unit and on the side of the pins 26 remote from the pinions 3. Thus, the captivating member 30 is movably retained on the track assembly and thereby the end of the machine adjacent to the cutter section is captivated or trapped to the track assembly.

The two captivating members have sufficient clearance on the track assembly to permit the machine to negotiate bends typically encountered in the track assembly but not sufficient to permit the pinions 3 to disengage the pins 26. Thus, the machine can be hauled along the articulated track assembly without fear of the machine disengaging the track assembly.

It will be seen that the present invention provides mining equipment enabling the cutter section of a ranging drum longwall mining machine to be trapped or captivated to a guide constituted by a track assembly extending along one side of the machine.

The present invention also may be applied to mining machines having ranging arms at both ends of the machine, respectively.

In addition the invention can be applied to machines having other haulage arrangements for example machines which have drive means engaging an elongated flexible member such as a chain or rope extending along the machine's path.

I claim:

1. Mine equipment for trapping or captivating a ranging arm mining machine to a guide extending along one side of the machine along a working face, the machine including a body, a support trunnion connected to the body, and a cutter-carrying ranging arm mounted on the support trunnion, including a bracket assembly securable to the support trunnion, the bracket assembly comprising a first component for attachment to the support trunnion and a second component for extending around the guide such that in use when the bracket assembly is mounted on the support trunnion the machine is trapped to or captivated to the guide.

2. Equipment as claimed in claim 1, in which the bracket assembly is adapted to help support the weight of the machine.

3. Equipment as claimed in claim 2, in which the second component is provided with at least one roller for engaging the guide.

4. Mine equipment as claimed in claim 1, in which the guide comprises a rack and in which the body comprises pinions connected to the rack for driving the machine to and fro along the rack, wherein the rack includes an upper plate and wherein the second component of the bracket assembly comprises rollers for mounting on the support plate.

5. Mine equipment as claimed in claim 4 wherein the guide comprises a rack and the machine body comprises a drive pinion for engaging the rack, and wherein the rack comprises upper and lower plates, wherein the horizontal rollers engage an upper surface of the upper plate, and the vertical limb extends downward along the rack on a side thereof opposite the trunion end face, and wherein a pad extends inward from the limb toward the rack between the upper and lower plates.

6. Mine equipment as claimed in claim 1, wherein the trunnion has a circular end face and wherein the first component of the bracket assembly is fixed to the circular end face of the trunnion and wherein the second component comprises a support frame extending around the guide and having horizontal rollers mounted in the support frame for engaging an upper surface of the guide, and having a vertical limb connected to the support frame and extending downwardly therefrom on a side of the guide opposite the circular end face of the trunnion.

7. A ranging arm mining machine traversable to and fro along a guide extending along one side of the machine along a working face, including a body, a support trunnion connected to the body, a cutter-carrying ranging arm mounted on the support trunnion, and trapping or captivating equipment comprising a bracket assembly secured to the support trunnion for engagement with the guide, the bracket assembly comprising a first component attached to the support trunnion and a second component extending around the guide such that in use the machine body is trapped or captivated to the guide.

8. A machine as claimed in claim 7, in which the bracket assembly helps to support the weight of the machine body.

9. A machine as claimed in claim 8, in which the second component is provided with at least one roller for engaging the guide.

10. The mining machine as claimed in claim 7 wherein the support trunion has an end face and wherein the first component of the bracket assembly is fixed to the end face of the support trunion, and wherein the second component of the bracket assembly extends outward from the first component and from the end face of the trunion outward over a guide and downward beside a guide on a side thereof opposite the end face of the trunion.

* * * * *